US009922627B1

(12) United States Patent
Martinez

(10) Patent No.: US 9,922,627 B1
(45) Date of Patent: Mar. 20, 2018

(54) COMPACT ASSEMBLY AND SYSTEM FOR RETAINING A BASS DRUM IN POSITION

(71) Applicant: Rafael Martinez, San Francisco, CA (US)

(72) Inventor: Rafael Martinez, San Francisco, CA (US)

( * ) Notice: Subject to any disclaimer, the term of this patent is extended or adjusted under 35 U.S.C. 154(b) by 0 days.

(21) Appl. No.: 15/436,120

(22) Filed: Feb. 17, 2017

Related U.S. Application Data

(60) Provisional application No. 62/297,232, filed on Feb. 19, 2016.

(51) Int. Cl.
*G10D 13/02* (2006.01)
*G10D 13/00* (2006.01)

(52) U.S. Cl.
CPC ..... *G10D 13/026* (2013.01); *G10D 13/00* (2013.01)

(58) Field of Classification Search
CPC ..... G10D 13/026; G10D 13/00
USPC ..... 84/421
See application file for complete search history.

(56) References Cited

U.S. PATENT DOCUMENTS 2,297,000 A * 9/1942 Kult ..... A47G 27/0206 180/90.6
3,096,677 A * 7/1963 Ryan ..... G10D 13/00 84/327
4,334,612 A * 6/1982 Beato ..... A45C 5/14 190/18 A
4,441,398 A * 4/1984 Baker ..... G10G 5/00 248/346.03
D295,053 S * 4/1988 Diaz ..... D17/22
D303,331 S * 9/1989 Diaz ..... D17/22
5,161,761 A * 11/1992 May ..... G10H 1/32 248/122.1
D352,951 S * 11/1994 Choate ..... D17/22
5,994,634 A * 11/1999 Cady ..... G10D 13/00 84/421
D466,146 S * 11/2002 Green ..... D17/22
7,420,111 B1 * 9/2008 Lynch ..... G10D 13/00 84/421
7,645,928 B2 * 1/2010 Graham ..... G10D 13/00 84/327
8,642,870 B1 * 2/2014 Rosa ..... A47G 27/0212 84/453
8,669,452 B2 * 3/2014 Waitzman, III ..... G10G 7/005 84/411 R
9,123,313 B2 * 9/2015 Hyams ..... G10D 13/00
(Continued)

*Primary Examiner* — David Warren
*Assistant Examiner* — Christina Schreiber
(74) *Attorney, Agent, or Firm* — Malloy & Malloy, P.L.

(57) ABSTRACT

A compact assembly for retaining a bass drum in position on a playing surface while it is played by a drummer seated on a drum stool. The compact assembly includes a mat component having a length and a width. The length of the mat component is sufficient to allow both a bass drum and a drum stool to be operatively positioned on opposite ends thereof while the mat component is disposed in an open operative configuration. A retention component comprises a retention member secured to a portion of one end of the mat component, and a cushion member is affixed to at least one side of the retention member. The cushion member engages a portion of the bass drum when the bass drum is disposed in an operative orientation on the mat component, thereby retaining the bass drum in position while a drummer is playing.

13 Claims, 7 Drawing Sheets

(56) References Cited

U.S. PATENT DOCUMENTS

| | | | | |
|---|---|---|---|---|
| 2010/0236382 | A1* | 9/2010 | Simbirdi | G09B 15/02<br>84/477 R |
| 2013/0086790 | A1* | 4/2013 | Hyams | G10D 13/00<br>29/428 |
| 2017/0169803 | A1* | 6/2017 | Pinelli | G10D 13/00 |

* cited by examiner

COMPACT ASSEMBLY AND SYSTEM FOR RETAINING A BASS DRUM IN POSITION

BACKGROUND OF THE INVENTION

Field of the Invention

A compact assembly for retaining a bass drum in position on a playing surface while it is played by a drummer includes a mat component having a retention component affixed to one end thereof. The retention component engages a portion of the bass drum and retains it in position on the mat component while it is played by the drummer.

Description of the Related Art

Drums are among the earliest types of musical instruments known to mankind. Modern drummers often have an entire drum kit surrounding them while they are seated on a drum stool behind the kit. An important component of any drum kit is a bass drum, which is typically positioned front and center of the drummer, while he or she is seated on a drum stool. Bass drums are often disposed in a vertical orientation, and a kick pedal is mounted on the side facing the drummer. The kick pedal includes a beater which the drummer activates by depressing the kick pedal, causing the beater to hit the head of the bass drum with greater or lesser force, thereby actuating the drummers playing as desired.

It is common while playing rock, heavy metal, industrial, and other forms of music for a drummer to exert considerable force on the kick pedal, such that the force from the beater causes the bass drum to move forward and away from the drummer, and in some cases, the remainder of the drum kit. This requires that the drummer adjust himself or herself relative to the bass drum while playing, and/or to frequently reposition the bass drum while playing. As can be appreciated, while this can be a tedious and time consuming effort while a drummer is rehearsing or recording, it may prove impracticable, if not impossible, for a drummer to accomplish while a drummer is playing before a live audience.

One attempt to resolve this problem has been to provide a large rug or mat onto which an entire drum kit is placed, and which has one or more elongated stops along a front edge against which one or more bass drums may be positioned against to prevent movement. While this setup may prove effective in retaining one for more bass drums in position, it presents several disadvantages. First, such an assembly is large and bulky. This creates a serious problem for younger and/or smaller working bands on tour who are often forced to transport the entire bands equipment in a small truck or trailer, or even in a car. As such, it is not possible for many drummers to make use of such a large rug or mat assembly simply because they are not able to transport the large assembly with them on tour.

A further disadvantage of such a large assembly is it limits a drummer's ability to arrange his or her kit. More in particular, because such large format assemblies include one or more elongated stops affixed along one end, the bass drum or drums must first be aligned against the stop(s), and the remainder of the kit must be set up around it. Once again, this does not always allow a drummer the flexibility desired in positioning the remainder of the kit around the bass drum.

In view of the significant limitations and disadvantages of such large format assemblies, the present inventor, a working drummer, developed a compact assembly consisting of an elongated mat having a rigid stop member attached at one end. While the inventor's original assembly somewhat served the purpose as it retained a bass drum in position relative to the mat, it did not effectively keep the mat in position on a playing surface, such as a stage. Further, the rigid stop member of the inventor's original assembly was found to cause damage to portions of the bass drum as a result of repeated forced contact therewith. Also, the rigid stop member of the present inventor's original assembly was aesthetically unappealing and detracted from the appearance of the drum kit while it was set up on a stage for a live performance before an audience.

As such, it would be beneficial to provide an assembly which may be quickly and easily disposed into an operative configuration to retain a bass drum in position while a drummer is playing. It would also be advantageous for such an assembly to be compact such that it may be easily transported and/or stored because, as noted above, space limitations are a major concern for touring musicians.

SUMMARY OF THE INVENTION

The present invention is directed to a compact assembly for retaining a bass drum in position on a playing surface while it is played by a drummer seated on a drum stool. In one embodiment, a compact assembly includes a mat component having a length and a width, wherein the length of the mat component is sufficient to allow both a bass drum and a drum stool to be operatively positioned on opposite ends thereof while the mat component is disposed in an open operative configuration. A retention component comprises a retention member secured to a portion of one end of the mat component, in one embodiment, and in one further embodiment, a cushion member is affixed to at least one side of the retention member. The cushion member engages a portion of the bass drum when the bass drum is disposed in an operative orientation on the mat component, thereby retaining the bass drum in position while a drummer is playing.

The present invention further comprises a compact system for retaining a bass drum in position while it is played by a drummer seated on a drum stool. In one embodiment, a compact system comprising a mat component having a length and a width, wherein the mat component has oppositely disposed ends, and the length of the mat component is sufficient to allow both the bass drum and the drum stool to be operatively positioned on opposite ends thereof. The compact system, in one embodiment, also includes a retention component having a retention member secured to a portion of one end of the mat component. In at least one embodiment of a compact system in accordance with the present invention, the mat component is at least partially retained in position on a playing surface by a weight of the drummer and the drum stool operatively positioned on the mat component oppositely disposed from the bass drum.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
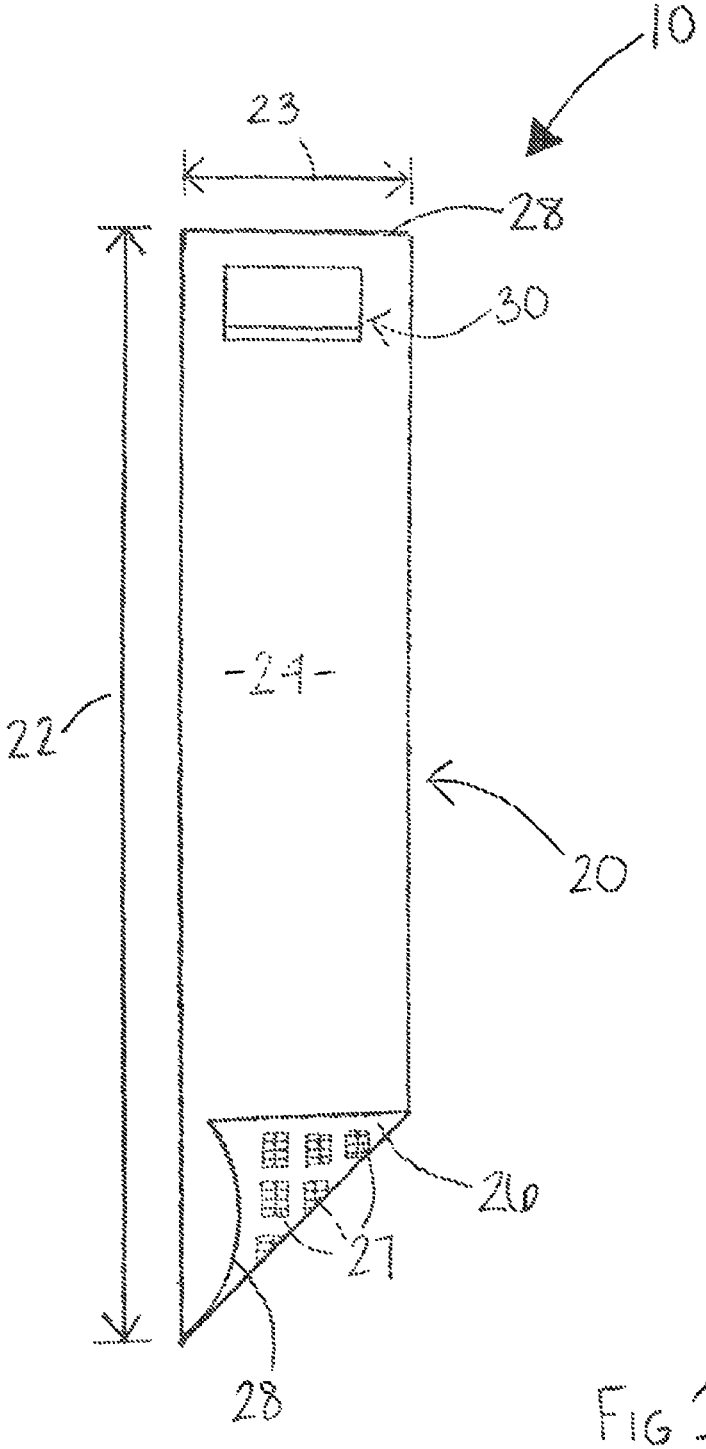
FIG. 1 is a plan view of one illustrative embodiment of a compact assembly for retaining a bass drum in position in accordance with the present invention.

The present invention is directed to a compact assembly for retaining a bass drum in position while it is played by a drummer, generally as shown as at 10 throughout the figures. Beginning with reference to illustrative embodiment of FIG. 1, a compact assembly 10 for retaining a bass drum in position comprises a mat component 20. In at least one embodiment, a mat component 20 comprises an elongated configuration having a length 22 which is substantially greater than the width 23. More in particular, and as shown in the illustrative embodiment of FIG. 1, a mat component 20 comprises an elongated configuration having oppositely disposed ends 28 along the length 22 thereof.

Further, a mat component 20 in accordance with the present invention comprises an upper surface 24 and oppositely disposed underside 26. As discussed in greater detail hereinafter, a bass drum, drum stool, and/or kick pedal are disposed on the upper surface 24 of a mat component 20 when operatively positioned thereon.

As may also be seen from FIG. 1, a compact assembly 10 for retaining a bass drum in position in accordance with at least one embodiment of the present invention further comprises a retention component 30. More in particular, and as best shown in the illustrative embodiment of FIG. 2, a compact assembly 10 in accordance with the present invention comprises a retention component 30 secured to a portion of the mat component 20. Looking further to the illustrative embodiments of FIGS. 1 and 2, a compact assembly 10 for retaining a bass drum in position, in at least one embodiment, comprises a retention component 30 secured proximate one of the oppositely disposed ends 28 of the mat component 20.

Figure 2:
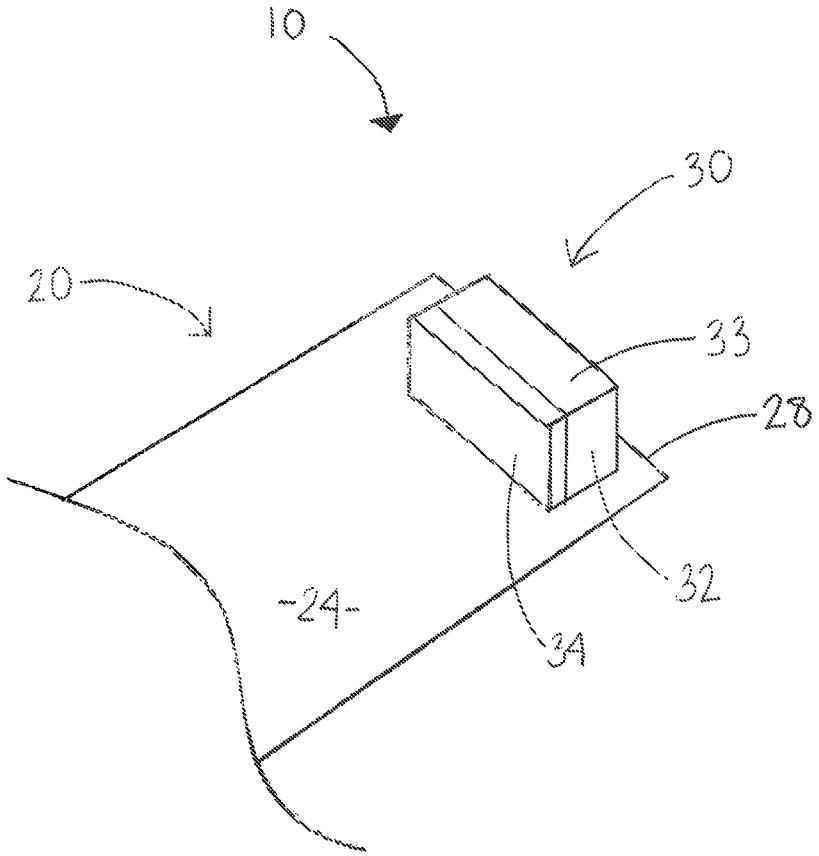
FIG. 2 is a partial perspective view of the illustrative embodiment of the compact assembly for retaining a bass drum in position of FIG. 1.

Looking further to FIG. 2, a retention component 30 in accordance with at least one embodiment of the present invention comprises a retention member 32. A retention member 32, in accordance with at least one embodiment of the present invention comprises a rigid material of construction, such as wood, hard plastic, metal, etc. In at least one further embodiment, a retention member 32 is dimensioned to operatively engage at least a lower portion of a bass drum and prevent the bass drum from moving in the direction in which the bass drum engages the retention member 32, while the bass drum is being played by a drummer, e.g., the bass drum is being hit with the beater of a kick pedal. In at least one embodiment, a retention member comprises a section of a standard 2 by 4 piece of wood.

In at least one further embodiment, a retention component 30 in accordance with the present invention comprises a cushion member 34, such as is shown in the illustrative embodiment of FIG. 2. A cushion member 34 in accordance with the present invention may comprise any of a number of resilient materials having a semi-rigid yet resilient material construction, such as, by way of example only, a dense polyurethane foam material, neoprene, etc. Of course, it would be appreciated by those with skill in the art, that a cushion member 34 in accordance with the present invention could comprise any of a number of other materials of construction provided it exhibits the necessary semi-rigid yet resilient properties required to retain a bass drum in position while it was played by a drummer, without causing abrasion to the contacted portions of the bass drum itself.

With reference once again to the illustrative embodiment of FIG. 2, a retention component comprises a cover 33 in at least one embodiment of the present invention. In accordance with one embodiment of the present invention, a cover 33 comprises a separate material, for example, cloth, canvas, carpeting, plastic sheet, plastic wrap, etc., which is affixed to a retention member 32 such as by stitching, gluing, stapling, heat shrinking, etc. In at least one other embodiment, a cover 33 comprises a paint or dye applied directly to the retention member 32 itself. A cover 33 comprises a predetermined color selected so as to minimize the visibility of the retention member 32 from a person seated in an audience while a drum kit is operatively positioned on the compact assembly 10 on a stage in accordance with the present invention. Stated otherwise, the cover 33 comprises a preselected color such that it does not detract from the appearance of a drum kit set up on a stage and operatively positioned on a compact assembly 10 in accordance with the present invention.

Figure 3:
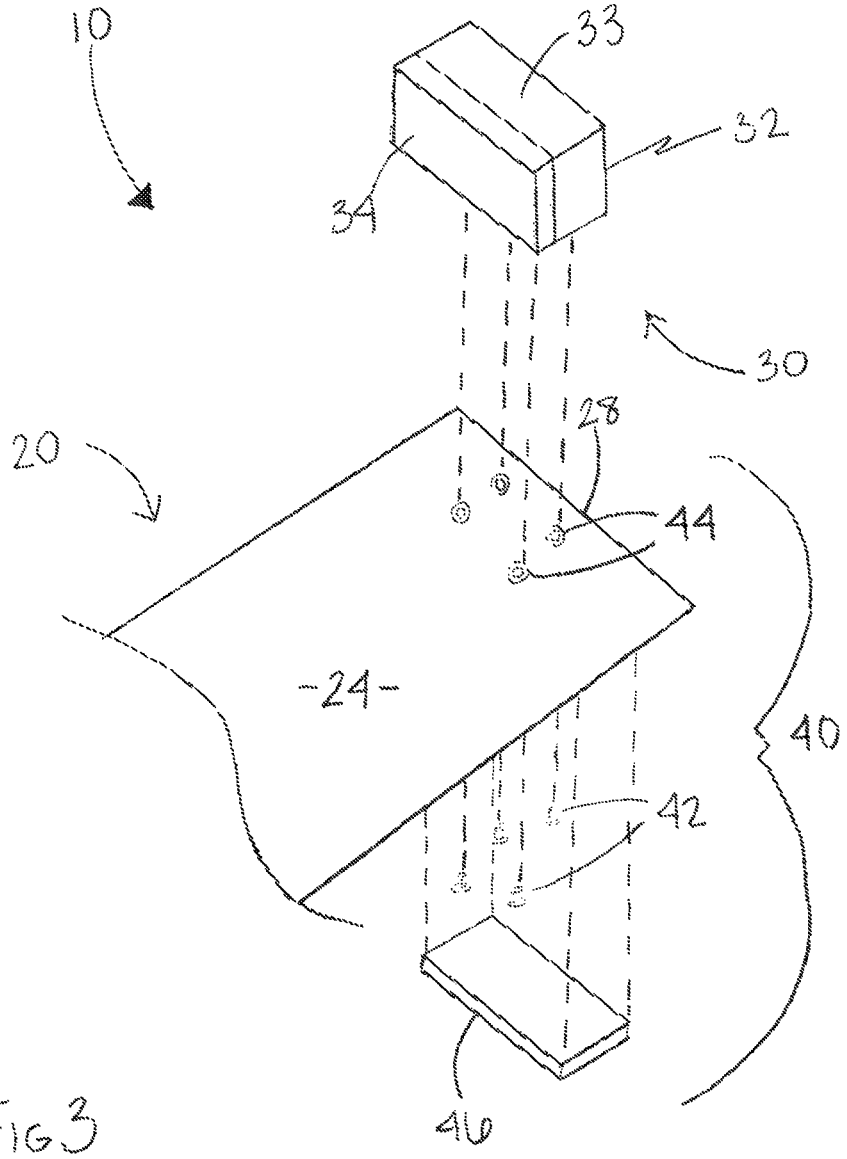
FIG. 3 is an exploded partial perspective view of the illustrative embodiment of the compact assembly for retaining a bass drum in position of FIG. 2.

FIG. 3 is an exploded partial perspective view of the illustrative embodiment of the compact assembly 10 for retaining a bass drum in position in accordance with FIG. 2. As may be seen from FIG. 3, in at least one embodiment, a compact assembly 10 for retaining a bass drum in position further comprises a fastener component as shown as at 40. In one embodiment, a fastener component 40 comprises at least one fastener 42, and in at least one further embodiment, a fastener component 40 comprises a plurality of fasteners 42, such as is shown by way of example in the illustrative embodiment of FIG. 3. With continued reference to the illustrative embodiment of FIG. 3, a fastener component in accordance with at least one embodiment of the present invention further comprises a plurality of grommets 44 secured to and through a mat component 24. As will be appreciated by those with skill in the art, the number and positioning of the plurality of grommets 44 may be altered while remaining within the scope and intent of the present invention. As will be appreciated from the illustrative embodiment of FIG. 3, in at least one embodiment, the plurality of grommets 44 of the fastener component 40 corresponds to the plurality of fasteners 42 utilized to secure retention component 30, and more in particular, the retention member 32 to a portion of a mat component 20.

In at least one further embodiment, a fastener component 40 in accordance with the present invention further comprises a fastener shield 46, as shown in the illustrative embodiment of FIG. 3. A fastener shield 46 in accordance with at least one embodiment of the present invention comprises a material of construction with a non-abrasive lower surface, so as not to damage the playing surface on which the mat component 20 is placed. A fastener shield 46 must also be durable enough to prevent the fasteners 42 from piercing therethrough, so as to prevent any abrasion and subsequent damage to a playing surface by the fasteners 42.

As will be appreciated by those of skill in the art, a fastener component 40 may comprise other mechanical or non-mechanical fastening mechanisms for securing a retention component 30 to a portion of a mat component 20 including, but not limit to, nails, screws, rivets, snaps, stitching, gluing, heat welding, corresponding hook and loop fasteners, just to name a few. As will also be appreciated by those of skill in the art, in at least one embodiment, a retention component 30 may be formed integral with a mat component 20, thereby eliminating the necessity of a separate fastener component 40 to secure the retention component 30 to the mat component 20.

Figure 4:
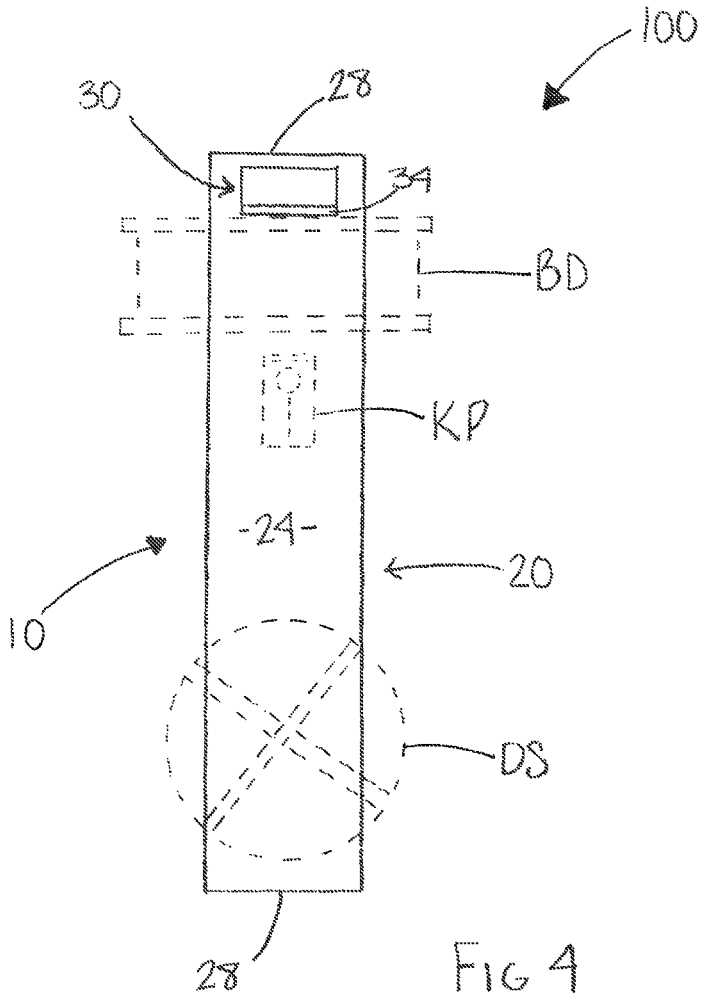
FIG. 4 is a plan view of one illustrative embodiment of a compact assembly and system for retaining a bass drum in position in accordance with the present invention having a bass drum and a drum stool operatively positioned therewith.
Figure 5:
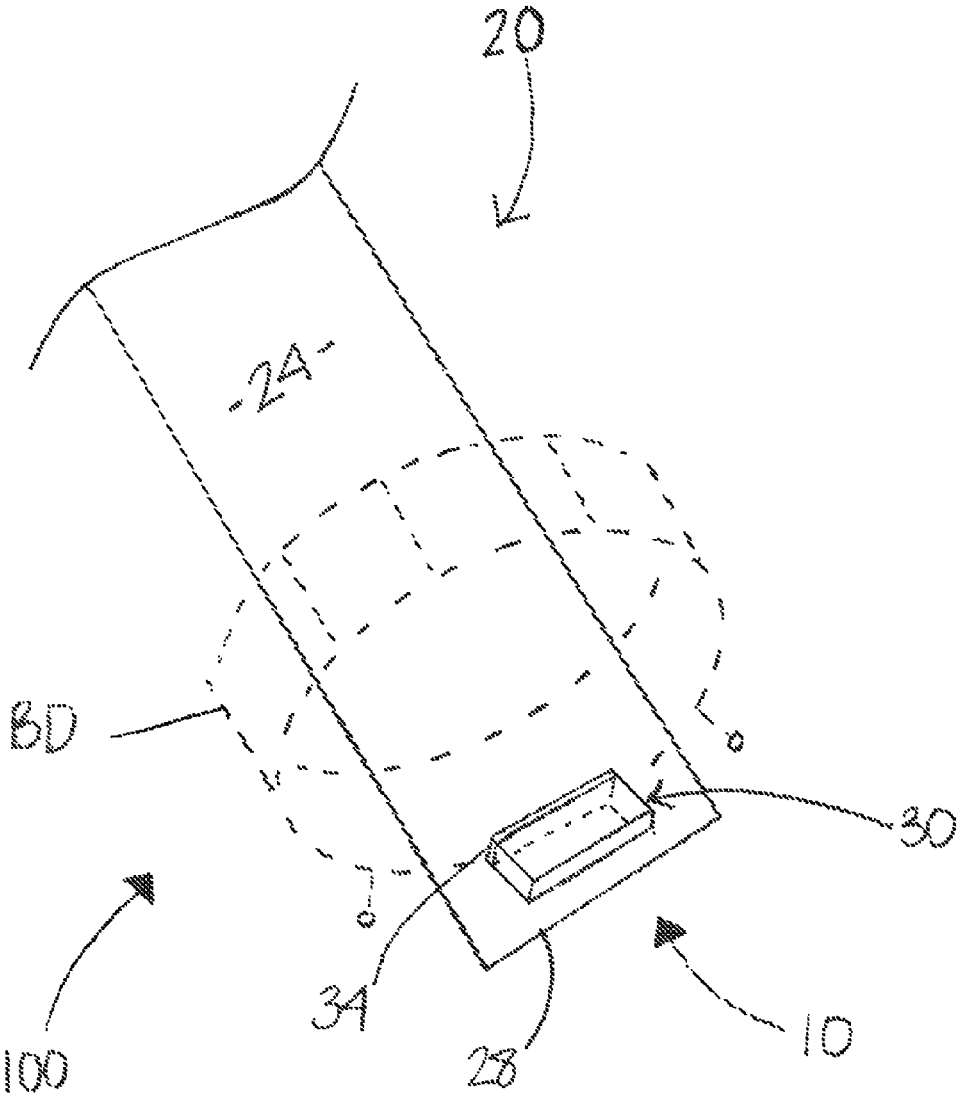
FIG. 5 is a partial perspective view of one illustrative embodiment of a compact assembly and system for retaining a bass drum in position having a bass drum disposed in an operative orientation therewith.

FIG. 4 presents a plan view of one illustrative embodiment of a compact assembly 10 and system 100 for retaining a bass drum in position in accordance with the present invention, having a bass drum (BD), kick pedal (KP), and a drum stool (DS) operatively positioned on a mat component 20 of a compact assembly 10. FIG. 4 is illustrative of one embodiment of a mat component 20 disposed in an open operative configuration in accordance with the present invention. As shown in the illustrative embodiment of FIG. 4, the front of bass drum (BD) is positioned so as to abut up against a retention component 30 which is secured to one end 28 of the mat component 20. More in particular, the bass drum (BD) is operatively positioned such that the front of the bass drum abuts up against cushion member 34 of retention component 30, as is shown more clearly in the illustrative embodiment of FIG. 5. As previously noted, cushion member 34 comprises a semi-rigid and resilient material so as to prevent abrasion and subsequent damage to the portion of the bass drum (BD) which is pushed forward towards and against the cushion member 34 while a drummer plays the bass drum.

With reference once again to the illustrative embodiment of FIG. 4, it will be appreciated by those of skill in the art that placing the drum stool (DS) in an operative position on one end 28 of the mat component 20, opposite the end 28 of the mat component 20 on which the bass drum (BD) is operatively positioned, serves to keep the mat component 20 in place along a playing surface while a drummer is seated on drum stool (DS) and playing bass drum (BD).

Looking once again to FIG. 1, in at least one embodiment, a mat component 20 in accordance with a compact assembly 10 of the present invention comprises a plurality of friction members 27 disposed on the underside 26 thereof. More in particular, friction members 27 comprise a tread-like pattern which grips a playing surface and inhibits movement of a mat component 20 thereover. Of course, it will be appreciated by those with skill in the art, that friction members 27 on the underside 26 of mat component 20 may comprises any number of tread-like patterns to grip a playing surface in order to inhibit movement of mat component 20 on a playing surface, to a greater or lesser degree. In at least one embodiment of the present invention, a mat component 20 comprises a slip proof carpet.

Figure 6:
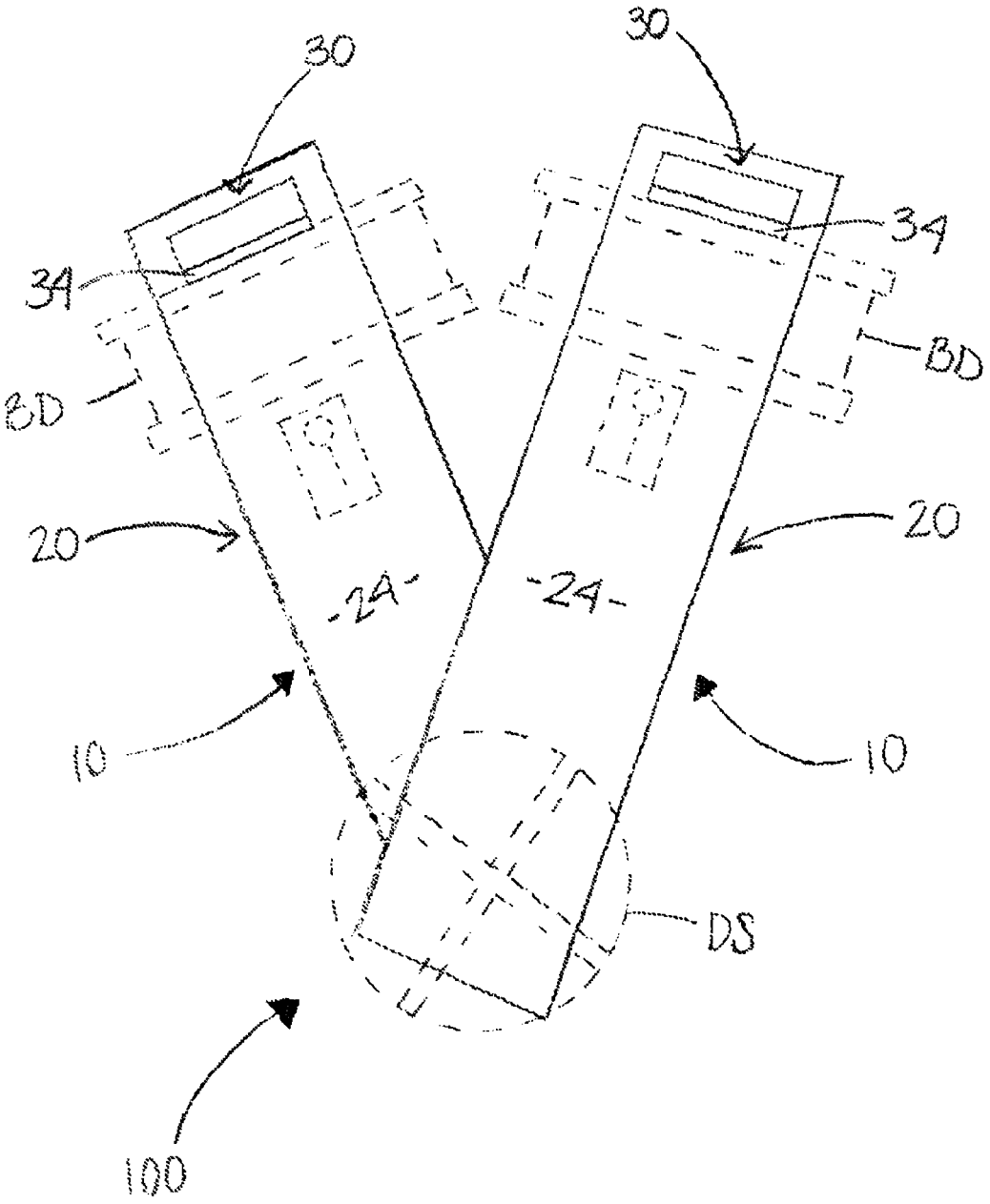
FIG. 6 is as a plan view of another illustrative embodiment of a compact assembly and system for retaining a bass drum in position in accordance with the present invention having a pair of bass drums and a drum stool operative positioned therewith.

Turning to the illustrative embodiment of FIG. 6, a compact system 100 for retaining a plurality of bass drums in position is shown. As may be seen from FIG. 6, a compact system 100 comprises a plurality of compact assemblies 10, each having a retention component 30 secured to one end 28 of a mat component 20. FIG. 6 further illustrates that a bass drum (BD) is operatively positioned on each mat component 20 adjacent a cushion member 34 of retention component 30. In at least one embodiment, a single drum stool (DS) is operatively positioned on an overlapping portion of each mat component 20 of the present compact system 100 for retaining a plurality of bass drums (BD) in position.

Figure 7:
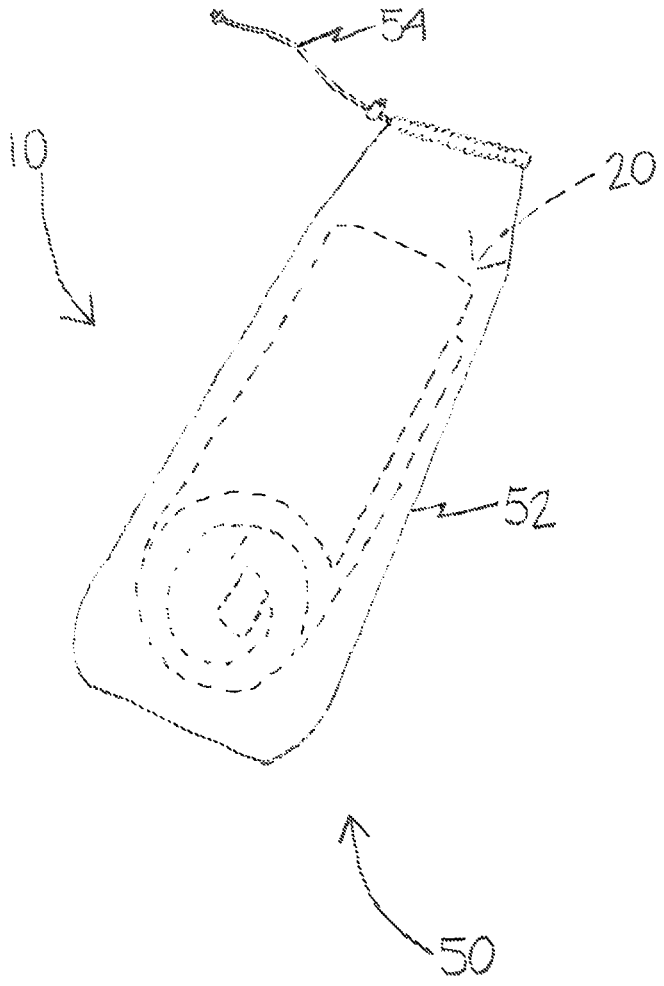
FIG. 7 is a perspective view of one illustrative embodiment of a compact assembly for retaining a bass drum in position disposed in a storage configuration within a storage component.

With reference to the illustrative embodiment of FIG. 7, a mat component 20 of a compact assembly 10 for retaining a bass drum (BD) in position is disposed in a rolled up storage configuration. More in particular, the mat component 20 is disposed in the rolled up storage configuration within a storage component 50. In at least one embodiment, a storage component 50 comprises a pouch 52 which is dimensioned to receive a mat component 20 while it is disposed in a rolled up storage configuration such as is shown by way of example in the illustrative embodiment of FIG. 7. In at least one further embodiment, a storage component 50 comprises a drawstring 54 to allow a user to cinch the open end of pouch 52 into a closed position, to prevent the mat component 20 from falling out of the pouch 52.

In at least one embodiment, a mat component 20 of a compact assembly 10 for retaining a bass drum in position in accordance with the present invention is dimensioned to fit within a bass drum itself for transport and/or storage, while the mat component 20 is disposed in a rolled up storage configuration, such as is shown, by way of example, in the illustrative embodiment of FIG. 7.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A compact assembly for retaining a bass drum in position while it is played by a drummer seated on a drum stool, said assembly comprising:

a mat component having a length and a width, a retention component attached to a portion of said mat component, said retention component comprises a retention member, a fastener component securing said retention member to said portion of said mat component, said fastener component comprises a plurality of grommets affixed to said portion of said mat component, and each of a corresponding plurality of fasteners securing said retention member to said mat component through a corresponding one of said plurality of grommets, said retention component further comprises a cushion member affixed to at least one side thereof, said cushion member engages a portion of the bass drum when the bass drum is in an operative orientation on said mat component, and a storage component.

2. The assembly as recited in claim 1 wherein said length of said mat component is sufficient to allow both the bass drum and the drum stool to be operatively positioned on opposite ends thereof.

3. The assembly as recited in claim wherein said retention component retains the bass drum in position on said mat component while it is played by the drummer.

4. A compact system for retaining a bass drum in position while it is played by a drummer seated on a drum stool, said system comprising:

a mat component having a length and a width, wherein the mat component has oppositely disposed ends, the length of the mat component is sufficient to allow both the bass drum and the drum stool to be operatively positioned on opposite ends thereof, a retention component, the retention component comprises a retention member secured to a portion of one end of the mat component, a fastener component securing the retention member to the portion of the mat component, the fastener component comprises a plurality of grommets affixed to the portion of the mat component, and each of a corresponding plurality of fasteners securing the retention member to the mat component through a corresponding one of the plurality of grommets, and the retention member comprises a cushion member affixed to at least one side thereof, the cushion member engaging a portion of the bass drum when the bass drum is disposed in an operative orientation on the mat component.

5. The system as recited in claim 4 wherein the fastener component further comprises a fastener shield affixed to an underside of the mat component in an overlying relation to the plurality of fasteners disposed through the corresponding plurality of grommets.

6. The system as recited in claim 5 wherein the retention component retains the bass drum in position relative to the mat component while the drummer is playing the bass drum.

7. The system as recited in claim 6 wherein the mat component is at least partially retained in position on a playing surface by a weight of the drummer and the drum stool operatively positioned on the mat component oppositely disposed from the bass drum.

8. The system as recited in claim 7 wherein the mat component further comprises a plurality of friction members disposed on an underside thereof, the plurality of friction members further retaining the mat component in position on the playing surface while the drummer is seated on the drum stool and playing the bass drum.

9. A compact assembly for retaining a bass drum in position on a playing surface while it is played by a drummer seated on a drum stool, said assembly comprising:

a mat component having a length and a width, said length of said mat component is sufficient to allow both the bass drum and the drum stool to be operatively positioned on opposite ends thereof while said mat component is disposed in an open operative configuration, a retention component, said retention component comprises a retention member secured to a portion of one end of said mat component, a fastener component securing said retention member to said portion of said mat component, said fastener component comprises a plurality of grommets affixed to said portion of said mat component, and each of a corresponding plurality of fasteners securing said retention member to said mat component through a corresponding one of said plurality of grommets, a cushion member affixed to at least one side of said retention member, said cushion member engages a portion of the bass drum when the bass drum is disposed in an operative orientation on said mat component, and a storage component.

10. The assembly as recited in claim 9 wherein said mat component is at least partially retained in position on the playing surface by the drummer and the drum stool operatively positioned on one end of said mat component opposite from the bass drum.

11. The assembly as recited in claim 10 wherein said mat component further comprises a plurality of friction members disposed on an underside thereof, said plurality of friction members further retaining said mat component in position on a playing surface while the drummer is seated on the drum stool and playing the bass drum.

12. The assembly as recited in claim 11 wherein said storage component comprises a pouch dimensioned to receive said mat component and said retention component therein while said mat component is disposed in a storage configuration.

13. The assembly as recited in claim 9 wherein said retention member further comprises a cover, said cover having a preselected color to minimize visibility of said retention member.

* * * * *